US010645781B1

(12) United States Patent
Wu et al.

(10) Patent No.: US 10,645,781 B1
(45) Date of Patent: May 5, 2020

(54) HIGH-VOLTAGE LINEAR DRIVE AND MEMORY DIMMING LED LIGHTING DEVICE

(71) Applicant: UNITY OPTO TECHNOLOGY CO., LTD., New Taipei (TW)

(72) Inventors: Chih-Hsien Wu, New Taipei (TW); Wei Chang, New Taipei (TW); Kai-Cheng Chuang, New Taipei (TW); Huan-Ying Lu, New Taipei (TW)

(73) Assignee: UNITY OPTO TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 16/512,398

(22) Filed: Jul. 16, 2019

(30) Foreign Application Priority Data

Jun. 3, 2019 (TW) ..... 108119173 A

(51) Int. Cl.

| | |
|---|---|
| ***H05B 37/00*** | (2006.01) |
| ***H05B 41/00*** | (2006.01) |
| ***H05B 45/37*** | (2020.01) |
| ***H05B 45/10*** | (2020.01) |
| ***H05B 45/48*** | (2020.01) |

(52) U.S. Cl.
CPC ..... *H05B 45/37* (2020.01); *H05B 45/10* (2020.01); *H05B 45/48* (2020.01)

(58) Field of Classification Search
CPC .... H05B 41/34; H05B 33/0803; H05B 39/09; H05B 41/28; H05B 33/0809; H05B 41/295; H05B 41/2827; H05B 41/3925; H05B 33/0815; H05B 33/0818; H05B 41/2828; H05B 41/3921; H05B 41/3927; H05B 37/029; H05B 37/0254; H05B 37/02; Y02B 20/202
See application file for complete search history.

(56) References Cited

U.S. PATENT DOCUMENTS

| | | | | |
|---|---|---|---|---|
| 2013/0057163 | A1* | 3/2013 | Sutardja | H05B 33/0857 315/185 R |
| 2014/0300274 | A1* | 10/2014 | Acatrinei | H05B 33/0815 315/85 |
| 2015/0351188 | A1* | 12/2015 | Chen | H02M 1/44 315/200 R |
| 2019/0045595 | A1* | 2/2019 | Johnsen | H05B 33/0815 |

* cited by examiner

*Primary Examiner* — Minh D A
(74) *Attorney, Agent, or Firm* — Fei-hung Yang

(57) ABSTRACT

A high-voltage linear drive and memory dimming LED lighting device is disclosed. The lighting device includes a high voltage linear constant current circuit, a control IC, a first LED string and a second LED string. The control IC is electrically connected to the high voltage linear constant current circuit, and the control IC is directly driven by receiving high voltage signals. Wherein, the control IC includes a voltage regulator module, a switching module and a memory module. The voltage regulator module is electrically connected to the high voltage linear constant current circuit; the switching module is electrically connected to the voltage regulator module and includes at least two electronic switches; and the memory module is electrically connected to the switching module.

8 Claims, 4 Drawing Sheets

HIGH-VOLTAGE LINEAR DRIVE AND MEMORY DIMMING LED LIGHTING DEVICE

CROSS-REFERENCE TO RELATED APPLICATIONS

This non-provisional application claims priority under 35 U.S.C. § 119(a) on Patent Application No(s). 108119173 filed in Taiwan, R.O.C. on Jun. 3, 2019, the entire contents of which are hereby incorporated by reference.

BACKGROUND

Technical Field

The present disclosure generally relates to the field of LED linear dimming. More particularly, the present disclosure relates to an LED lighting device capable of driving the color temperature modulation of the latter stage by a high voltage signal of a front linear dimming in a linear dimming architecture, while having a color temperature memory function.

Description of Related Art

In general, a common way of driving a conventional light emitting diode (LED) is a switching power driving method, wherein this method is divided into Buck, Boost, Buck/Boost, and Flyback. These driving methods have their own advantages and disadvantages. For example, the flyback method has the advantages of high LED utilization rate, free of strobes, isolated design, and no substantial change of efficiency caused by the input voltage, and the disadvantages of too-many components, complicated design, high cost, and electromagnetic interference (EMI) issue. Other methods such as the buck/boost method have lesser disadvantages than the flyback method, but the non-isolated design has a risk of use. Further, some of the LED driving methods adopt a linear architecture which uses direct current voltage as a trigger signal, so that the LED driver produces continuous changes with the output current to form and adjust a constant current to change the brightness of the LED. A common method is to adjust the variable resistance of the serial connection, or drive an analog voltage by the DIM pin of an IC component, so as to complete linear analog dimming. Since the LED dimming method of the linear architecture has many advantages such as simple circuit design, convenient operation, and low cost, so that many LED driving circuits adopt the linear dimming architecture.

In addition to the adjustment of the brightness of the LED, the change of color temperature is also a common function of the present lamp. To cope with different requirements of the LEDs, each of the aforementioned driving architecture needs to find a way of adjusting the color temperature. For example, the conventional isolated architecture usually uses a Primary Side Regulation (PSR) feedback method for the mains power of 120 VAC, and a Microcontroller Unit (MCU) as a control means. However, the microcontroller, regardless of 8 bits or higher, has a driving voltage much smaller than the high voltage value of the mains power, so that it is necessary to decrease the high voltage to a level such as 5.1V before driving the MCU of the micro digital control to output a digital signal of the color temperature change, and the voltage across the LED panel is dropped to approximately 36V.

However, the LED adopts the high-voltage low-current driving method in the linear drive analog dimming architecture, so that the high voltage output is inevitable. In other words, the voltage is outputted with a value equal to the ideal mains power (120V) times the square root of 2 which is approximately equal to 169V. As a result, the low-voltage MCU using the digital adjusting method cannot be used as the dimming means. Although the serially connected resistors can be used as a voltage divider means, the overall temperature will be too high and the lamp panel may be burned or damaged easily. To achieve the advantages of the linear dimming architecture and the function of providing both color temperature adjustment and memory functions under the condition of high voltage, the team of this disclosure based on years of experience in the related industry to conduct extensive research and experiment, and finally developed a high-voltage linear drive and memory dimming LED lighting device in accordance with this disclosure to overcome the drawbacks of the prior art.

SUMMARY

In view of the aforementioned drawbacks of the prior art, the inventor of the present disclosure discloses an LED lighting device in a linear dimming architecture capable of driving a color temperature modulation of the latter stage directly by a high voltage signal of the front linear dimming while having a color temperature memory function, so that the LED driving circuit of the present disclosure can dim and modulate color temperature completely by a linear dimming mechanism.

To achieve the aforementioned and other objectives, the present disclosure provides a high-voltage linear drive and memory dimming LED lighting device, comprising: a high voltage linear constant current circuit, for converting an externally inputted high voltage AC signal into a high voltage DC signal; a control IC, electrically coupled to the high voltage linear constant current circuit, and driven directly by receiving a high voltage signal, and the control IC further comprising: a voltage regulator module (Low Dropout Regulator, LDO), electrically coupled to the high voltage linear constant current circuit; a switching module, electrically coupled to the voltage regulator module, and having at least two electronic switches; and a memory module, electrically coupled to the switching module; a first LED string, electrically coupled to the high voltage linear constant current circuit and the control IC, and having a first color temperature; and a second LED string, electrically coupled to the high voltage linear constant current circuit and the control IC, and having a second color temperature; wherein the light of the first LED string and the light of the second LED string are mixed to form a third color temperature.

Preferably, the electronic switches are metal oxide semiconductor field effect transistors (MOSFET), and the ON/OFF states of the MOS components define a truth table, and state of the truth table determines the display of the first color temperature, the second color temperature, or the third color temperature.

Preferably, the memory module is an Electrically-Erasable Programmable Read-Only Memory (EEPROM).

Preferably, the memory module has a timing chart, and the timing of the high voltage AC signal after the high voltage linear constant current circuit is rectified is further compared to determine the current color temperature performance state.

Preferably, the memory module has a reset unit with a reset time and a number of times of ON/OFF, and if the number of times of ON/OFF satisfies the condition within the reset time, the color temperature performance will return to its default lighting state.

Preferably, the truth table comprises a first state, a second state, a third state, and a memory and automatic switching state, and the first state just turns on the first LED strings; the second state turns on the first LED strings and the second LED strings simultaneously; the third state just turns on the second LED strings; and at the memory and automatic switching state, wall switch is turned on/off and the color temperatures of the first state, the second state and the third state are switched and controlled sequentially according to the information of the truth table.

Preferably, the first color temperature is 3000K, and the second color temperature is 5000K.

Preferably, the reset time is two seconds; the number of times of ON/OFF is equal to seven.

Preferably, the high voltage linear constant current circuit has a TRIAC dimmer.

In summation of the description above, the high-voltage linear drive and memory dimming LED lighting device of the present disclosure adopts the conventional flyback architecture together with the modulation method of the microprocessor, and a linear dimming architecture is provided by driving the color temperature modulation of the latter stage directly by the high voltage signal of the front linear dimming, so that the LED driving circuit of the present disclosure can dim and adjust color temperature completely by the linear dimming mechanism to maintain the advantages including the simple design, convenient operation, and low cost of the linear dimming circuit. In the meantime, the present disclosure gives up the control method by using the MCU and uses MOS components to define color temperature of different states instead, and the color temperature can be adjusted accordingly, and the EEPROM is provided to achieve the subsequent functions such as the color temperature memory function.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF THE EMBODIMENTS

Figure 1:
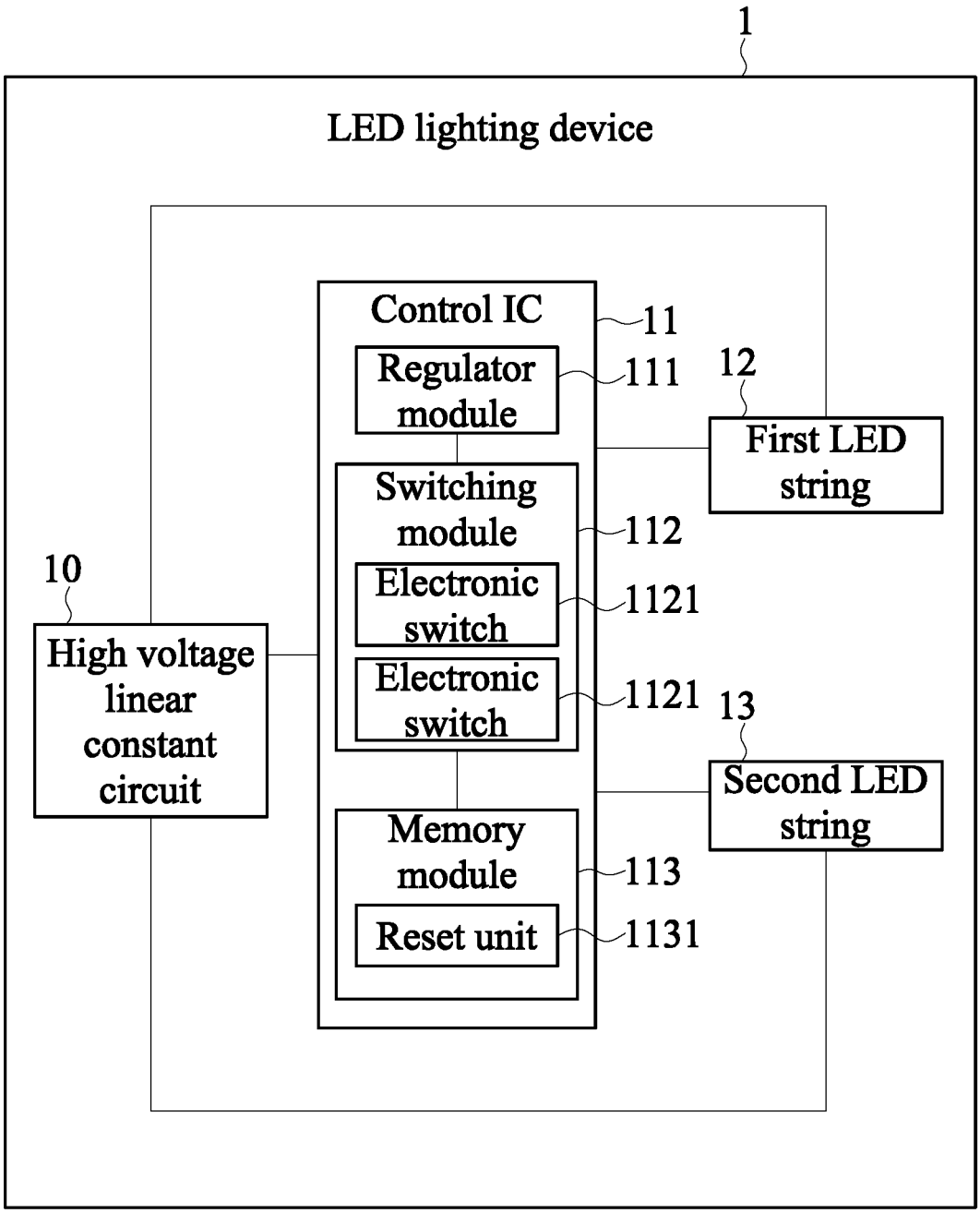
FIG. 1 is a schematic block diagram of a preferred embodiment of this disclosure.

Reference will now be made in detail to the present embodiments of the disclosure, examples of which are illustrated in the accompanying drawings. Wherever possible, the same reference numbers are used in the drawings and the description to refer to the same or like parts.

The technical content of the present disclosure will become apparent by the following description and schematic illustrations, and the circuit, timing chart, truth table, color temperature as shown in the figures are provided for the purpose of illustrating the technical characteristics of this disclosure only, but not intended for limiting the scope of the disclosure. Please refer to FIGS. 1-4 for a schematic block diagram, a schematic circuit diagram, and a timing chart of a preferred embodiment of the present disclosure and a schematic diagram showing a modulation mechanism of this disclosure respectively.

The present disclosure is directed to a high-voltage linear drive and memory dimming LED lighting device 1, comprising a high voltage linear constant current circuit 10, a control IC 11, a first LED string 12 and a second LED string 13.

The high voltage linear constant current circuit 10 is provided for converting an externally inputted high voltage AC signal into a high voltage DC signal. In this architecture, after external AC mains power is rectified by a full-bridge rectification and smoothened and converted into a DC signal, the present disclosure does not aim at how to improve the power factor or reduce the strobe in the linear dimming architecture, but essentially designs a driving condition of high voltage and low current outputted from a load side, even though slight adjustment of the circuit or feedback control has been made to reduce the strobe and improve the performance under the linear architecture, and has the same voltage state equal to the voltage state of the high voltage linear constant current circuit 10 of the present disclosure. Further, the control IC 11 is electrically coupled to the high voltage linear constant current circuit 10, and driven by receiving the high voltage signal directly, wherein the control IC 11 comprises a voltage regulator module 111, a switching module 112 and a memory module 113. The voltage regulator module 111 is electrically coupled to the high voltage linear constant current circuit 10, and the switching module 112 is electrically coupled to the voltage regulator module 111, and the switching module 112 has at least two electronic switches 1121, and the memory module 113 is electrically coupled to the switching module 112. The first LED string 12 is electrically coupled to the high voltage linear constant current circuit 10 and the control IC 11, and the first LED string 12 has a first color temperature, and the second LED string 13 is electrically coupled to the high voltage linear constant current circuit 10 and the control IC 11, and the second LED string 13 has a second color temperature, wherein the lights of the first LED string 12 and the second LED string 13 are mixed to form a third color temperature. With the aforementioned technical characteristics, the present disclosure provides an LED lighting device 1 capable of driving the color temperature modulation of a later stage directly by the high voltage signal of the front linear dimming under the linear dimming architecture, while providing the color temperature memory function, so that the LED driving circuit can dim and modulate the color temperature completely by the linear dimming mechanism, so as to maintain the advantages of the simple design, convenient operation and low cost of the linear dimming circuit.

To define different color temperature performance states, the present disclosure uses a binary electronic circuit in the switching module 112 for identifying different states. In addition, the present disclosure uses a high voltage driving method at the load side, so that no MCU is used as a control component during the color temperature process. To achieve the binary state performance, metal oxide semiconductor field effect transistors (MOSFET) are chosen as the electronic switches 1121, and the ON/OFF state of the electronic switches 1121 determines the output of 0 or 1 to define a truth table, and the first color temperature, the second color temperature or the third color temperature is displayed based on the state of the truth table. In addition, the memory module 113 is an Electrically-Erasable Programmable Read-Only Memory (EEPROM).

Figure 2:
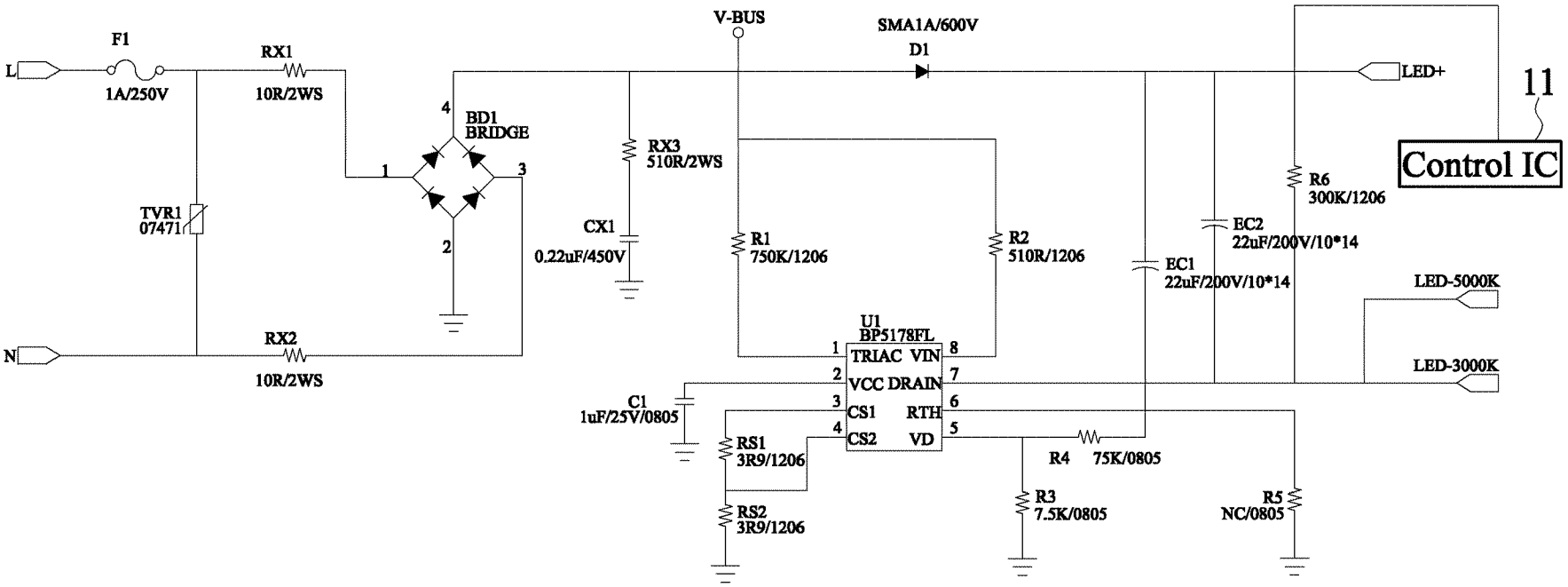
FIG. 2 is a schematic circuit diagram of a preferred embodiment of the present disclosure.
Figure 3:
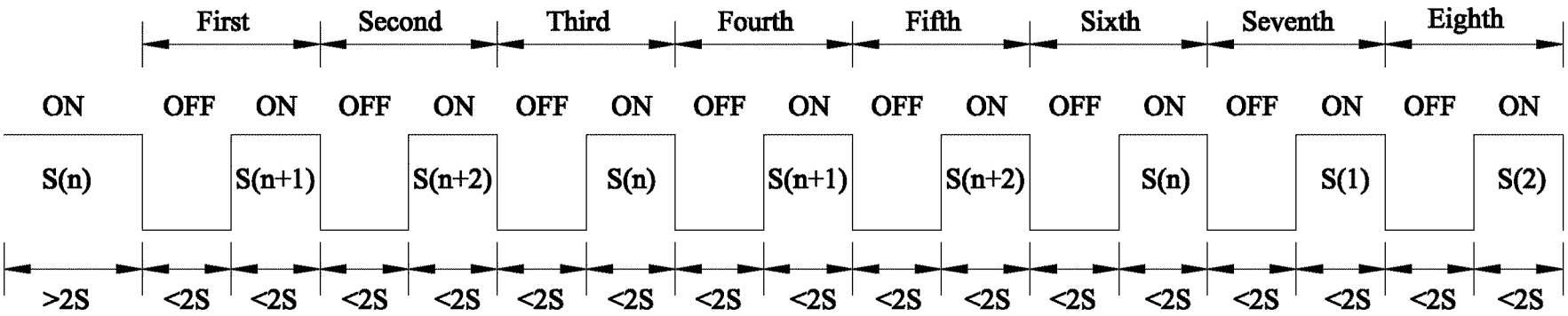
FIG. 3 is a timing chart of a preferred embodiment of the present disclosure.

Further, the memory module 113 has a timing chart. After the high voltage linear constant current circuit 10 is rectified, the timing of the high voltage AC signal is compared. In FIG. 2, a phase detection of the waveform of the V-BUS is performed after the full-wave rectification takes place, and compared with the timing chart to determine the color temperature performance state of the current color temperature performance state. With reference to FIG. 3 for the timing of the preferred embodiment of the present disclosure, this figure is provided for the purpose of illustration only, and the settings of an actual application may be adjusted according to different requirements.

In addition, the memory module 113 has a reset unit 1131 for setting a reset time and a number of times of ON/OFF. After the number of times of ON/OFF satisfies the reset time, the color temperature performance will be returned to the default lighting state. The reset unit 1131 can reset the LED lighting device 1 and return to the default lighting performance. Particularly, if several LED lighting devices 1 are installed, the reset mechanism is provided for users to correct each of the LED lighting devices 1 and make it to turn to the same default lighting state, so as to reduce the level of difficult of the control made by the users. In a preferred embodiment, the reset time is two seconds and the number of times of ON/OFF is seven, and such strict reset procedure is provided to reduce the chance of wrong actions and avoid resetting the lighting state due to a smaller number of times of ON/OFF made by a user within a short time and the reset unit may misjudge the condition.

Figure 4:
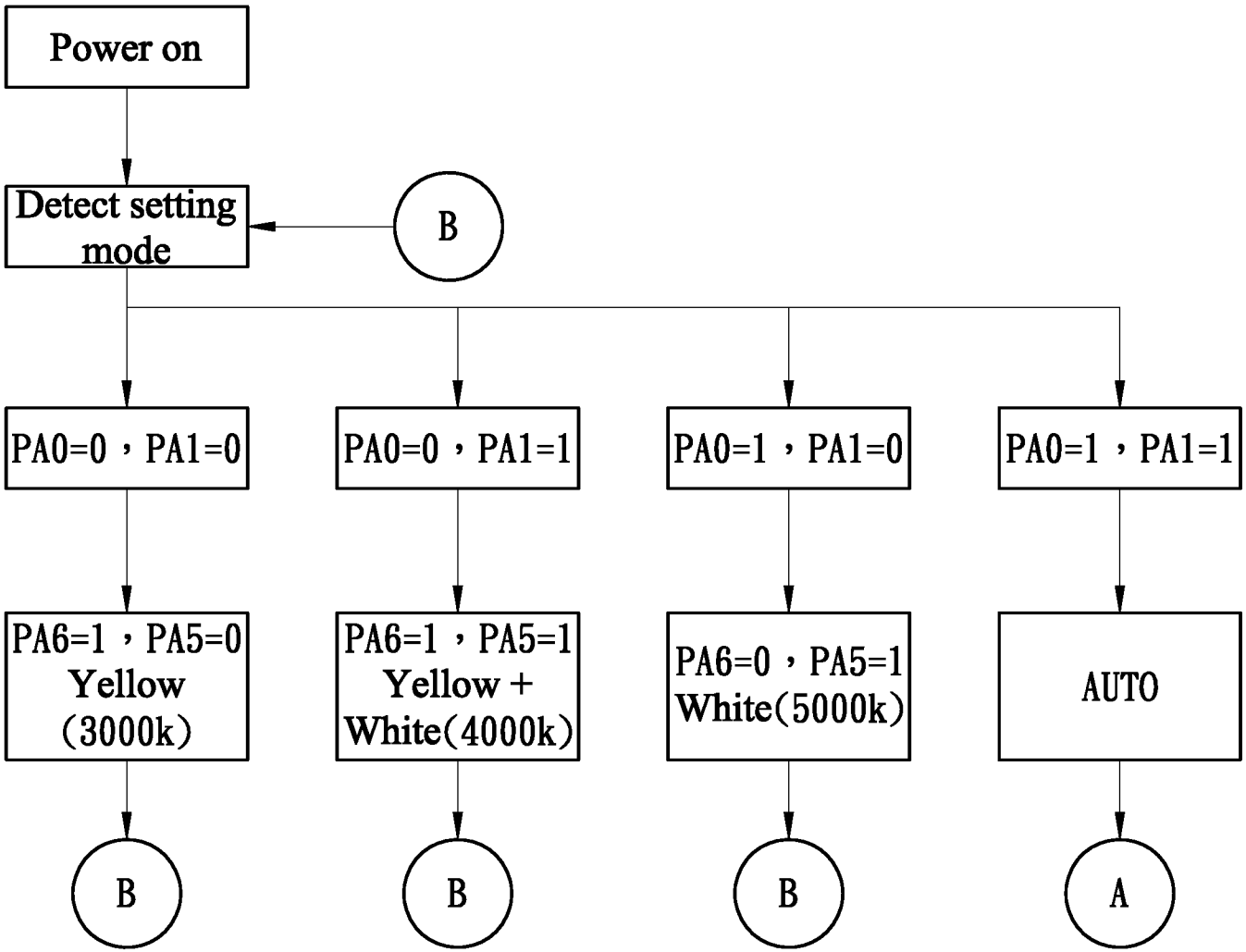
FIG. 4 is a schematic diagram showing a modulation mechanism of a color temperature state in accordance with a preferred embodiment of the present disclosure.

Preferably, the lighting device of the present disclosure may use a wall switch (not shown in the figure) as an automatic color temperature switch or limit the lighting device to a fixed color temperature only. To achieve various different color temperature performance states, the truth table may define a first state, a second state, a third state, and a memory and automatic switching state, wherein the first state just turns on the first LED strings 12 at a fixed power only; the second state turns on the first LED strings 12 and the second LED strings 13 simultaneously at the fixed power; and the third state just turns on the second LED strings 13 at a fixed power. At the memory and automatic switching state, the ON/OFF action of the wall switch is controlled to switch the color temperature of the first state, the second state and the third state sequentially according to the truth table information. The switching and mixing control of the color temperature can improve the stability of the color temperature modulation and the adjusting performance of the LED lighting device 1. The color temperature modulation mechanism is shown in FIG. 4.

In this embodiment, only two different color temperature LED strings are used, and they can be all or partially turned on to define three color temperature performances, so that the first color temperature is 3000K, and the second color temperature is 5000K, and the third color temperature formed by mixing the first and second color temperatures is preferably 4000K, but such arrangement is just a preferred embodiment only, and it can be changed according to application requirements. In this embodiment, the high voltage linear constant current circuit 10 has a TRIAC dimmer provided for improving the convenience of the linear dimming. As described above, the present disclosure is integrated with the TRIAC dimmer and still situated at a driving condition of outputting a high voltage low current at a load side, and the voltage state is the same as the voltage state outputted by the high voltage linear constant current circuit 10 of the present disclosure.

In summation of the description above, the high-voltage linear drive and memory dimming LED lighting device 1 of the present disclosure does not adopt the conventional flyback architecture together with the modulation method of the microprocessor, but uses the linear dimming architecture to drive the color temperature modulation of the latter stage directly by the high voltage signal of the front linear dimming, so that the LED driving circuit of the present disclosure can dim and adjust color temperature completely by the linear dimming mechanism to maintain the advantages including the simple design, convenient operation, and low cost of the linear dimming circuit. In the meantime, the present disclosure gives up the control method by using the MCU and uses MOS components to define color temperature of different states instead, and the color temperature can be adjusted accordingly, and the EEPROM is provided to achieve the subsequent functions such as the color temperature memory function.

What is claimed is:

1. A high-voltage linear drive and memory dimming LED lighting device, comprising:

a high voltage linear constant current circuit, for converting an externally inputted high voltage AC signal into a high voltage DC signal;

a control IC, electrically coupled to the high voltage linear constant current circuit, and driven directly by receiving a high voltage signal, and the control IC further comprising:

a voltage regulator module, electrically coupled to the high voltage linear constant current circuit;

a switching module, electrically coupled to the voltage regulator module, and having at least two electronic switches; and a memory module, electrically coupled to the switching module;

a first LED string, electrically coupled to the high voltage linear constant current circuit and the control IC, and having a first color temperature; and a second LED string, electrically coupled to the high voltage linear constant current circuit and the control IC, and having a second color temperature; wherein the light of the first LED string and the light of the second LED string are mixed to form a third color temperature, wherein the electronic switches are electronic switches which as semiconductor field effect transistors, and the ON/OFF states of the electronic switches define a truth table, and the first color temperature, the second color temperature, or the third color temperature are determined according to the state of the truth table.

2. The LED lighting device of claim 1, wherein the memory module is an electrically erasable programmable read only memory (EEPROM).

3. The LED lighting device of claim 2, wherein the memory module has a timing chart, and the timing of the high voltage AC signal after the high voltage linear constant current circuit is rectified is further compared to determine the current color temperature performance state.

4. The LED lighting device of claim 3, wherein the memory module has a reset unit with a reset time and a number of times of ON/OFF, and if the number of times of ON/OFF satisfies the condition within the reset time, the color temperature performance will return to its default lighting state.

5. The LED lighting device of claim 4, wherein the truth table comprises a first state, a second state, a third state, and a memory and automatic switching state, and the first state just turns on the first LED strings; the second state turns on the first LED strings and the second LED strings simultaneously; the third state just turns on the second LED strings; and at the memory and automatic switching state, wall switch is turned on/off and the color temperatures of the first state, the second state and the third state are switched and controlled sequentially according to the information of the truth table.

6. The LED lighting device of claim 5, wherein the first color temperature is 3000K, and the second color temperature is 5000K.

7. The LED lighting device of claim 6, wherein the reset time is two seconds, and the number of time of ON/OFF is equal to seven.

8. The LED lighting device of claim 7, wherein the high voltage linear constant current circuit has a TRIAC dimmer.

* * * * *